US011160428B2

(12) United States Patent
Lee et al.

(10) Patent No.: US 11,160,428 B2
(45) Date of Patent: Nov. 2, 2021

(54) CLEANER

(71) Applicants: LG ELECTRONICS INC., Seoul (KR); IUCF-HYU (INDUSTRY-UNIVERSITY COOPERATION FOUNDATION HANYANG UNIVERSITY), Seoul (KR)

(72) Inventors: Sangchul Lee, Seoul (KR); Changgun Lee, Seoul (KR); Kietak Hyun, Seoul (KR); Sejin Yook, Seoul (KR); Sanghee Woo, Gyeonggi-do (KR); Seungyoon Noh, Gyeonggi-do (KR)

(73) Assignees: LG ELECTRONICS INC., Seoul (KR); IUCF-HYU (INDUSTRY-UNIVERSITY COOPERATION FOUNDATION), Seoul (KR)

( * ) Notice: Subject to any disclaimer, the term of this patent is extended or adjusted under 35 U.S.C. 154(b) by 177 days.

(21) Appl. No.: 16/453,122

(22) Filed: Jun. 26, 2019

(65) Prior Publication Data

US 2020/0008636 A1 Jan. 9, 2020

(30) Foreign Application Priority Data

Jul. 3, 2018 (KR) ..... 10-2018-0076998

(51) Int. Cl.

| | |
|---|---|
| ***A47L 9/16*** | (2006.01) |
| ***A47L 5/22*** | (2006.01) |
| ***B04C 5/185*** | (2006.01) |
| ***B04C 5/28*** | (2006.01) |
| ***B04C 9/00*** | (2006.01) |

(Continued)

(52) U.S. Cl.

CPC ..... *A47L 9/1625* (2013.01); *A47L 5/22* (2013.01); *A47L 9/1641* (2013.01); *A47L 9/1683* (2013.01); *B04C 5/04* (2013.01); *B04C 5/185* (2013.01); *B04C 5/28* (2013.01); *B04C 9/00* (2013.01); *B04C 2009/007* (2013.01)

(58) Field of Classification Search

CPC .... A47L 9/1625; A47L 9/1641; A47L 9/1683; A47L 9/1608; A47L 9/165; A47L 5/22; A47L 5/24; B04C 5/185; B04C 5/28; B04C 5/04; B04C 9/00; B04C 2009/007

See application file for complete search history.

(56) References Cited

U.S. PATENT DOCUMENTS

2017/0319033 A1* 11/2017 Hyun ..... A47L 9/1625
2018/0000304 A1* 1/2018 Zhong ..... B04C 5/26

* cited by examiner

*Primary Examiner* — Lucas A Stelling
*Assistant Examiner* — Hafiz Muhammad Aamir
(74) *Attorney, Agent, or Firm* — KED & Associates LLP

(57) ABSTRACT

A cleaner includes a housing having a hollow inner space, a housing partition configured to divide the inner space into an first space and a second space, first and second communication holes formed through the housing partition to allow the first and second spaces to communicate with each other, an inlet through which air from an outside of the housing is introduced into the second space, an air discharge port through which air in the first space is exhausted to the outside of the housing, a fan arranged in the first space to draw air to the air discharge port, a first cyclone arranged in the second space to guide air to the first communication hole and separate dirt from the air, and a second cyclone arranged in the second space to guide a portion of air to the second communication hole and separate dirt from the air.

20 Claims, 9 Drawing Sheets

(51) Int. Cl.

| | |
|---|---|
| ***B04C 5/04*** | (2006.01) |
| ***A47L 5/24*** | (2006.01) |

CLEANER

CROSS-REFERENCE TO RELATED APPLICATION

This application claims priority under 35 U.S.C. § 119 to Korean Application No. 10-2018-0076998 filed on Jul. 3, 2018, whose entire disclosure is hereby incorporated by reference.

BACKGROUND

1. Field

A cleaner is disclosed herein.

2. Background

A cleaner is a device for cleaning an indoor space by suctioning dirt such as dust or the like. A related art cleaner may include a housing having a suction part and an air discharge part, a fan configured to move air introduced into the suction part to the air discharge part, and a separator configured to separate dirt from the air moved by the fan.

The separator provided in the related art cleaner may be composed of a plurality of pipes for moving air introduced into the suction part to the air discharge part. Each of the pipes may form an independent flow path, and the dirt contained in the air may be separated from the air by the centrifugal force while the air is moved to the air discharge part along each pipe.

The related art cleaner provided with a plurality of pipes which are independent from each other has a drawback. During the operation of the fan, the pressure of the air introduced into the housing through the suction part may drop as the air is introduced into each pipe of the separator. Since the dirt contained in the air is separated from the air by the centrifugal force while moving along the respective pipes constituting the separator, decrease in pressure of the air introduced into each pipe means that performance of separating dirt from the air may be degraded.

BRIEF DESCRIPTION OF THE DRAWINGS

The embodiments will be described in detail with reference to the following drawings in which like reference numerals refer to like elements wherein.

DETAILED DESCRIPTION

Figure 1:
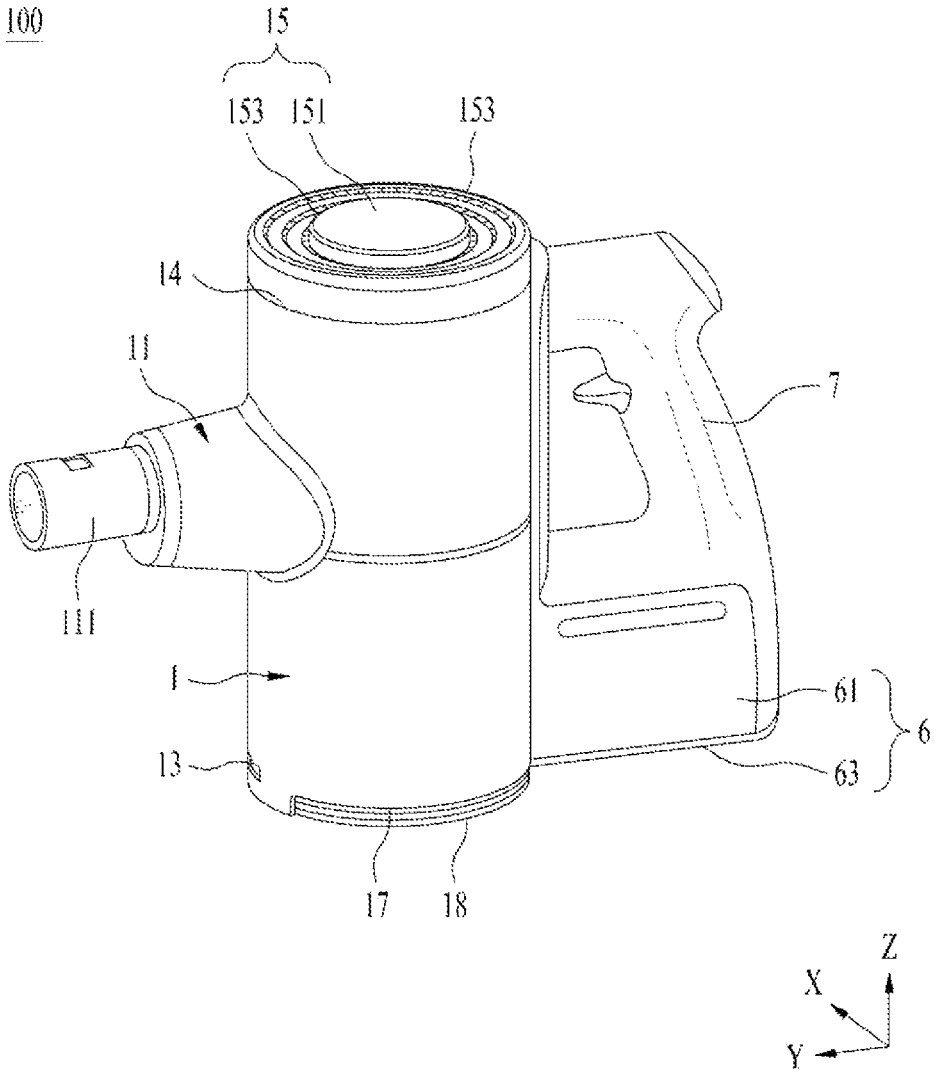
FIGS. 1 and 2 show a cleaner according to an embodiment of the present disclosure.

FIG. 1 shows a cleaner 100 according to an embodiment of the present disclosure. The cleaner of the embodiment may include a cylindrical housing 1 having a hollow inner space, a suction part (or inlet) 11 through which air flows into the housing 1, an air discharge part or port 153 configured to discharge air from the housing 1, and a handle 7 attached to the housing.

Figure 2:
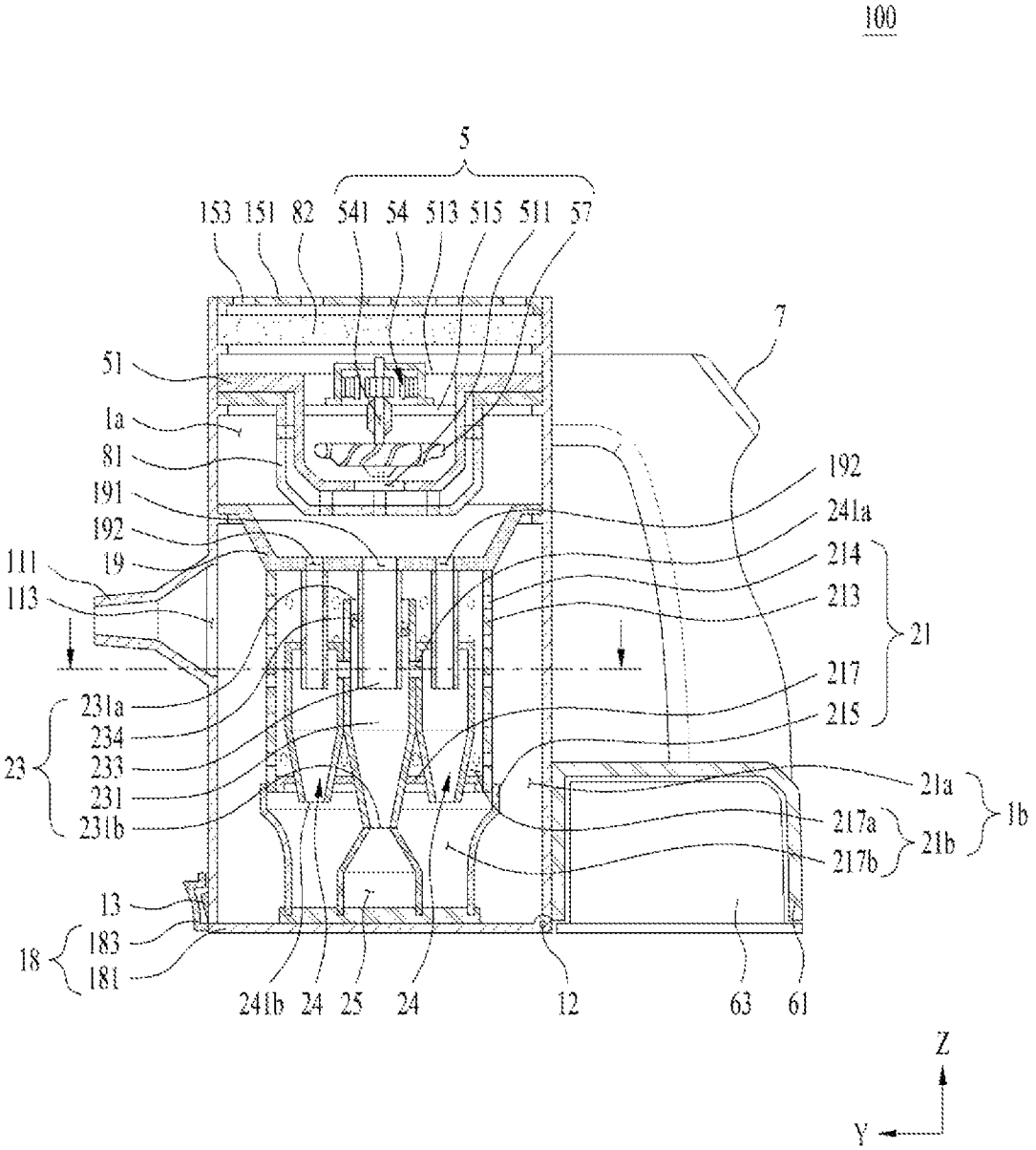

As shown in FIG. 2, the housing 1 may include a housing partition 19 that divides an internal space into a first housing space 1*a* (upper space) and a second housing space 1*b* (lower space). The suction part 11 may be located in the lower space 1*b* and the air discharge part 153 may be located in the upper space 1*a*.

The suction part 11 may be arranged on the circumferential surface of the housing 1 to introduce outside air into the lower space 1*b*. The suction part 11 may include a suction port 113 formed on a circumferential surface of the housing 1 in a penetrating manner, and a suction duct 111 extending from the suction port 113. The cleaner may further include an extension pipe detachably provided to the suction duct 111, and a nozzle arranged at a free end of the extension pipe to move dirt to the extension pipe.

The air discharge part 153 may be provided in the top surface or the circumferential surface of the housing 1 in a penetrating manner to discharge air from the housing 1. As shown in FIG. 2, the air discharge part 153 may be provided in the top surface of the housing 1.

A housing through hole 14 (see FIG. 1) may be provided on the top surface of the housing 1. The housing through hole 14 may be opened and closed by an upper cover 15. As will be described later, filtration units (or filters) 81 and 82 for filtering air may be arranged in the housing. A user may separate the filtration units from the housing 1 and clean the same.

The upper cover 15 may include an upper cover body 151 having a shape corresponding to the shape of the housing through hole 14. In this case, the air discharge part 153 may include a plurality of through holes penetrating the upper cover body.

A housing outlet 17 (see FIG. 1) for discharging dirt stored inside the housing 1 to the outside may be provided in or at the bottom surface of the housing 1 (one surface of the first housing positioned opposite to the air discharge part). The housing outlet 17 may be opened and closed by a cover 18.

The cover 18 may include a cover body 181 pivotably fixed to the housing 1. In this case, the circumferential surface of the housing 1 may include a shaft 12 forming a rotation center of the cover body 181 and a fastening part (or latch catch) 13 arranged at a position facing the shaft 12, and the cover body 181 may include a cover fastening part (or latch) 183 detachably coupled to the fastening part 13.

The cover body 181 may further include a sealing portion that is pressed between the housing 1 and the cover body 181 when the housing outlet 17 is closed. The sealing portion may be formed of an elastic material such as rubber.

The housing partition 19 may include a first communication hole 191 and a second communication hole 192 which allow the upper space and the lower space to communicate with each other, and a fan 5 is arranged in the upper space 1*a*. The fan 5 may include a case 51 arranged in the upper space 1*a* of the housing, an impeller 57 rotatably arranged in the case 51, and a motor 54 fixed to the case to rotate the impeller 57.

The case 51 may include a case inlet 511 and a case outlet 513. The case inlet 511 may be formed in or at one surface of the case 51 facing the first communication hole 191 and the second communication hole 192, and the case outlet 513 may penetrate one surface of the case 51 facing the air discharge part 153. This configuration may minimize flow resistance between the communication holes 191 and 192 and the air discharge part 153.

The motor 54 may be fixed to a support portion 515 positioned between the case inlet 511 and the case outlet 513, and a rotary shaft 541 of the motor ma be connected to the impeller 57 through the support portion 515. The motor 54 may be supplied with power through a power source provided in an indoor space or may be supplied with power from a battery 63 that is detachably attachable to the housing 1. In the latter case, the housing 1 may include a battery housing 61 for providing a space for accommodating the battery 63.

When power is supplied to the motor 54 and the impeller 57 rotates, air may flow into the lower space 1*b* through the suction part 11. The air introduced into the lower space may move to the upper space through the communication holes 191 and 192. The air introduced into the upper space 1*a* may be discharged from the housing via the case inlet 511, the case outlet 513, and the air discharge part 153.

A dirt separator 2 (see FIG. 3) configured to guide the air introduced into the suction part 11 to the fan 5 may be arranged in the lower space 1*b* of the housing. Dirt such as dust contained in the air, for example, may be separated from the air by the centrifugal force while moving to the fan 5 along a flow path provided by the dirt separator 2. The dirt separator may be configured as follows.

The dirt separator 2 may include a chamber formation part (or inner housing) 21 configured to divide the lower space 1*b* of the housing into a first chamber or space 21*a* and a second chamber or space 21*b*, a first cyclone formation part 23 configured to guide air to the first communication hole 191, and a second cyclone formation part 24 arranged in the second chamber 21*b* to guide air to the second communication hole 192.

The chamber formation part 21 may include a chamber body 213, 215 having a cylinder having one end fixed to the housing partition 19 and an opposite end contacting the cover 18, the chamber body 213, 215 dividing the lower space 1*b* into the two chambers 21*a* and 21*b*, and a chamber partition 217 configured to divide the second chamber 21*b* formed in the chamber body into a first space 217*a* and a second space 217*b*.

The chamber body 213, 215 may divide the first chamber 21*a* allowing the lower space 1*b* to communicate with the suction part 11 and the second chamber 21*b* communicating with the first communication hole 191 and the second communication hole 192. The suction part 11 and the communication holes 191 and 192 may be divided by the chamber body.

The chamber body may include a first cylinder 213 fixed to the housing partition 19 and a second cylinder 215 fixed to the first cylinder. The first communication holes and the second communication holes 191 and 192 may be arranged such that the second chamber 21*b* communicates with the upper space 1*a* of the housing. The second cylinder 215 may have one end fixed to the free end of the first cylinder 213 and an opposite end contacting the cover 18.

A plurality of chamber communication holes 214 allowing the first chamber 21*a* to communicate with the first space 217*a* therethrough may be formed in a circumferential surface of the first cylinder 213. Air introduced into the first chamber 21*a* through the suction part 11 may be supplied into the first space 217*a* of the second chamber 21*b* through the chamber communication holes 214. Thus, a space between the housing 1 and the chamber body 213 may be defined as a primary cyclone that separates large foreign objects from the air introduced through the suction part 11.

A chamber outlet 216 may be provided on one surface of the second cylinder 215 which contacts the cover body 181. Dirt stored in the second cylinder 215 may be discharged from the housing 1 through the chamber outlet 216 when the cover body 181 opens the housing outlet 17.

The chamber partition 217 may be fixed to one of the first cylinder 213 and the second cylinder 215, thereby dividing the inside of the second chamber 21*b* into two spaces 217*a* and 217*b*. The first space 217*a* may communicate with the communication holes 191 and 192, while the second space 217*b* may be a space (dirt storing space) that does not communicate with the communication holes 191 and 192.

The first cyclone formation part 23 may guide air introduced into the second chamber 21*b* to the first communication hole 191. The second cyclone formation part 24 may guide a part of air from the first cyclone formation part 23 to the second communication hole 192.

Dirt contained in the air introduced into the first cyclone formation part 23 may be separated from the air by the centrifugal force while the air moves to the first communication hole 191 along the first cyclone formation part 23. Similarly, dirt contained in the air introduced into the second cyclone formation part 24 may be separated from the air by the centrifugal force while the air moves to the second communication hole 192 along the second cyclone formation part 24.

The first cyclone formation part 23 may include a first flow path body 231 having a pipe shape. One end of the first flow path body 231 may be located in the first space 217*a* and an opposite end of the first flow path body 231 may pass through the chamber partition 217 and be located in the second space 217*b*.

One end of the first flow path body 231 may include a first body inlet 231*a* for introducing air into the first flow path body 231. The opposite end of the first flow path body 231 may include a first body outlet 231*b* for discharging dirt from the first flow path body 231 to the second space 217*b*. FIG. 2 illustrates an example in which the first body inlet 231*a* may be a hole penetrating the top surface of the first flow path body 231.

The first flow path body 231 may be formed as a pipe having a diameter decreasing as the pipe extends toward the first body outlet 231*b*. This configuration may maintain the strength of airflow formed inside the first flow path body 231.

The air in the first flow path body 231 may be moved to the upper space 1*a* through a first connection duct 233. The first connection duct 233 may be a pipe having one end fixed to the first communication hole 191 and a free end inserted into the first body inlet 231*a* and disposed inside the first flow path body 231.

A first airflow formation part (or first guide vane) 234 may be arranged between the circumferential surface of the first connection duct 233 and the circumferential surface of the first flow path body 231. The first airflow formation part 234 may cause air flowing into the first body inlet 231*a* to rotate inside the first flow path body 231. The first airflow formation part 234 may be positioned between the first body inlet 231*a* and the free end of the first connection tube 233.

The air may be rotated inside the first flow path body to separate the dirt from the air by the centrifugal force. If the first airflow formation part 234 is arranged at a position lower than the free end of the first connection duct 233, the air may be moved to the upper space 1*a* through the first connection duct 233 without the dirt being separated therefrom. The first airflow formation part 234 may be a spiral plate positioned between the circumferential surface of the first connection duct 233 and the circumferential surface of the first flow path body 231.

Figure 3:
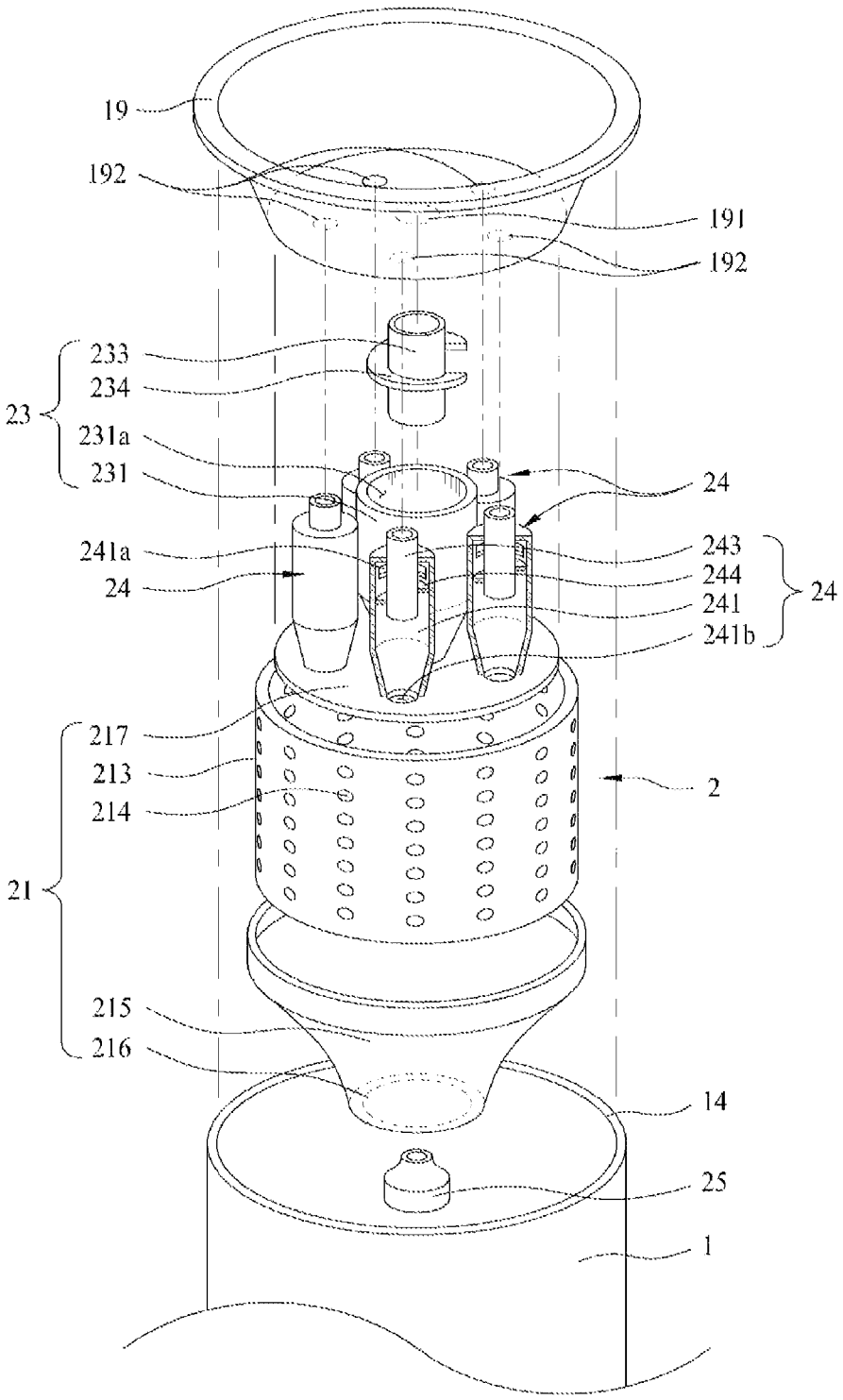
FIGS. 3 and 4 illustrate a dirt separator according to an embodiment.

As shown in FIG. 3, the second cyclone formation part 24 may include a second flow path body 241 having one end located in the first space 217*a* and an opposite end passing through the chamber partition 217 and located in the second space 217*b*. The top surface of the second flow path body 241 may be formed as a closed surface and the bottom surface of the second flow path body 241 may include a second body outlet 241*b* for discharging dirt from the second flow path body 241 to the second space 217*b*. The second flow path body 241 may be formed as a pipe having a diameter decreasing as the pipe extends toward the second body outlet 241*b*.

The air in the second flow path body 241 may be movable to the upper space 1*a* through the second connection duct 243. The second connection duct 243 may be formed as a pipe having one end fixed to the second communication hole 192 and a free end located in the second flow path body 241 through the closed top surface of the second flow path body 241.

The second flow path body 241 may be supplied with air from the first flow path body 231 through a second body inlet 241*a*. The second body inlet 241*a* may penetrate the circumferential surface of the first flow path body 231 and the circumferential surface of the second flow path body 241 such that the second flow path body 241 communicates with the first flow path body 231.

Figure 4:
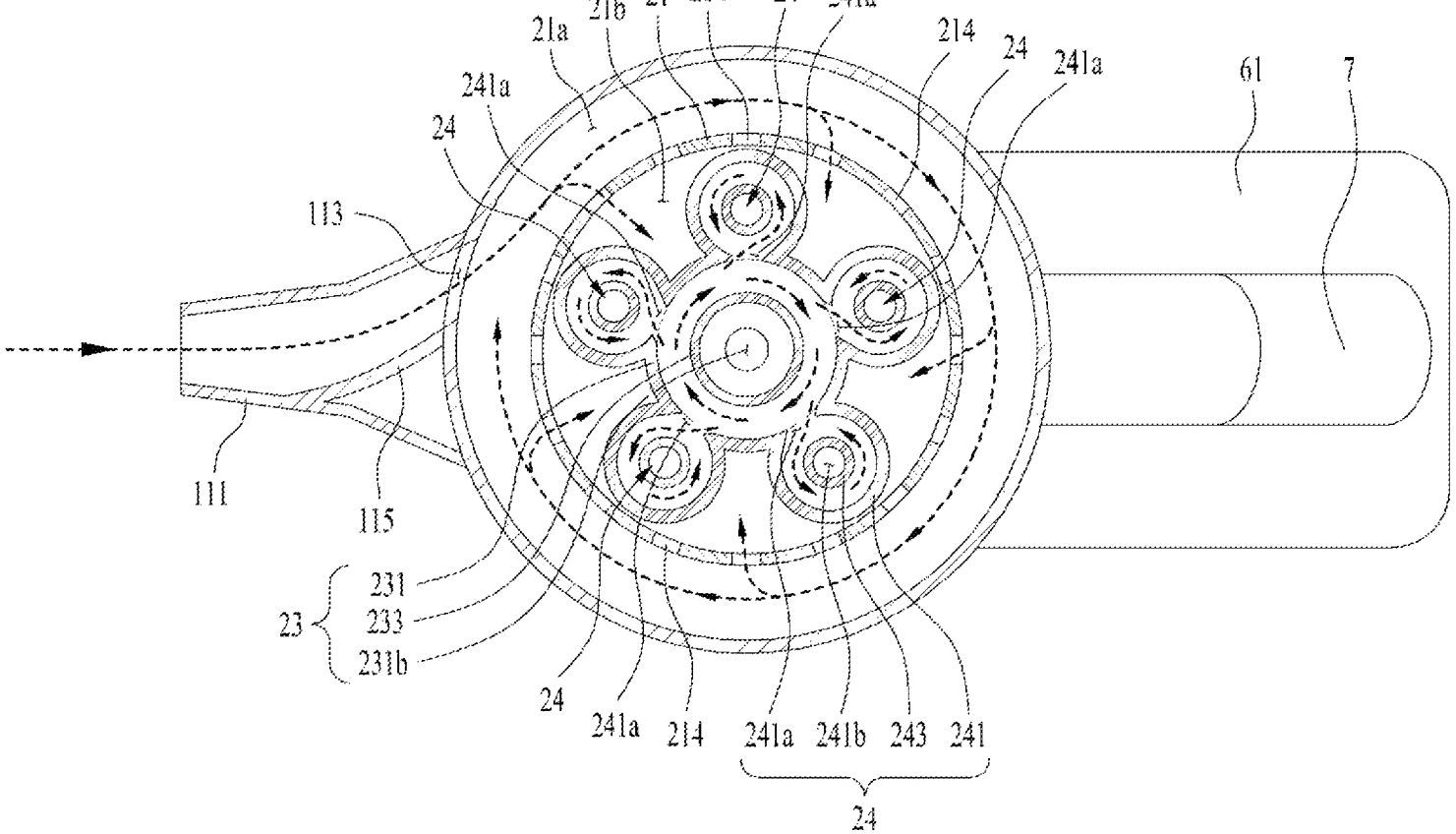

A second airflow formation part (or guide vane) 244 may be further provided in the second flow path body 241 to rotate air introduced through the second body inlet 241*a* in the second flow path body 241. The second airflow formation part 244 may be formed as a spiral plate positioned between the circumferential surface of the second connection duct 243 and the circumferential surface of the second flow path body 241. However, as shown in FIG. 4, when the second body inlet 241*a* is arranged to introduce air into the second flow path body 241 in the tangential direction to the circumferential surface of the second flow path body 241, the second cyclone formation part may not need a separate second airflow formation part.

The dirt separator 2 according to the embodiment may include two more second cyclone formation parts 24. FIG. 3 shows an example where the dirt separator 2 has five second cyclone formation parts 24. When two or more second cyclone formation parts 24 are provided, the second cyclone formation parts 24 may be equally spaced apart along the circumferential surface of the first flow path body 231.

This may make a similar amount of air supplied to each second cyclone formation part 24. If an excessively large amount of air is supplied to a second cyclone formation part 24, it may be difficult to separate the dirt contained in the air. If an excessively small amount of air is supplied to a second cyclone formation part, the efficiency of the second cyclone formation parts 24 will be lowered. The above-mentioned issues may be addressed when the second cyclone formation parts 24 are equally spaced apart along the circumferential surface of the first flow path body 231.

Hereinafter, operation of the cleaner 100 having the above-described structure will be described. As shown in FIG. 4, when power is supplied to the motor 54 to rotate the impeller 57, air may be introduced into the first chamber 21*a* of the housing through the suction duct 111 and the suction port 113. A guide 115 may be arranged in the suction duct 111. The guide 115 may introduce air in the tangential direction to the circumferential surface of the housing 1, which defines the first chamber 21*a*. Accordingly, the air may make a rotational movement (a cyclonic movement) in the first chamber 21*a*. In this operation, the dirt contained in the air may move to the bottom surface 18 in the lower space along the circumferential surface of the housing 1.

As shown in FIG. 2, the air rotating in the first chamber 21*a* may be introduced into the first space 217*a* of the second chamber 21*b* through the chamber communication holes 214. The air introduced into the first space 217*a* may move to the first flow path body 231 through the first body inlet 231*a*.

The air flowing into the first body inlet 231*a* may be rotated inside the first flow path body 231 by the first airflow formation part 234. A portion of the air rotated inside the first flow path body 231 may move to the second flow path body 241 through the second body inlet 241*a*, and the remainder of the air may move to the upper space 1*a* through the first connection duct 233. When the air is rotated inside the first flow path body 231, the dirt contained in the air may be discharged into the second space 217*b* along the circumferential surface of the first flow path body 231, and the air may move to the upper space 1*a* through the first connection duct 233.

As shown in FIG. 4, the air introduced into the second flow path body 241 may also be rotated inside the second flow path body 241. When a cyclonic flow is generated in the second flow path body 241, the dirt contained in the air may be moved to the edge of the flow path (the circumferential surface of the second flow path body) by the centrifugal force and then discharged into the second space 217*b* by gravity, and the air may be moved to the upper space 1*a* through the second connection duct 243.

As described above, the second flow path body 241 provided in the second cyclone formation part 24 may receive air from the first flow path body 231. Accordingly, pressure drop of the air introduced into each of the first flow path body and the second flow path body may be minimized compared to a case where the flow path bodies are independent from each other. The case where the second flow path body is independent from the first flow path body may not mean that the second flow path body receives a portion of the air introduced into the first flow path body, but means that the second flow path body directly receives the air introduced into the first space 217*a* of the second chamber.

If the second flow path body 241 is independent from the first flow path body 231, the pressure of the air introduced into the first space 217*a* may drastically decrease as the air is supplied to the respective flow path bodies 231 and 241. In the present embodiment, the second flow path body 241 may be dependent on the first flow path body 231, and accordingly the pressure drop of the air introduced into the respective flow path bodies 231 and 241 may be minimized. By minimizing the pressure drop of the air introduced into each of the flow path bodies 231 and 241, the rotational speed of the air rotated inside each flow path body may be increased, thereby improving the performance of separating dirt from the air.

As shown in FIG. 2, a storage body 25 for storing dirt discharged through the first body outlet 231*b* of the first flow path body may be further provided in the second space 217*b*. The storage body 25 may divide the interior of the second space 217*b* into a space for storing dirt discharged from the second flow path body 241 and a space for storing dirt discharged from the first flow path body 231. This arrangement may prevent the dirt discharged from the first flow path body 231 from moving to the second flow path body 241 through the second body outlet 241*b* as the pressure inside the first flow path body 231 may be higher than the pressure inside the second flow path body 241.

In order to filter out residual dirt remaining in the air discharged from the first cyclone formation part 23 and the second cyclone formation part 24, the present embodiment may include a first filter 81 arranged between the housing partition 19 and the case inlet 511, and a second filter 82 arranged between the case outlet 513 and the air discharge part 153.

The second filter 82 may be configured to filter out dirt having a size smaller than that of the dirt filtered out by the first filter 81. In other words, the diameter of the filtration holes of the second filter 82 may be smaller than the diameter of the filtration holes of the first filter 81.

The above-described embodiment is based on the case where the lower space 1*b* of the housing is divided into the first chamber 21*a* and the second chamber 21*b* by the chamber formation part 21. The lower space 1*b* may not need to be divided into the first chamber 21*a* and the second chamber 21*b*. The lower space 1*b* may form a single chamber (and a chamber formation part may not be provided).

The first cyclone formation part 23 may include a first flow path body 231 having a pipe shape and extending from the cover 18 arranged on the bottom surface of the lower space 1*b* toward the housing partition 19, a first body inlet 233 formed in the top surface of the first flow path body 231, a first connection duct 233 having one end fixed to the first communication hole 192 and a free end inserted into the first body inlet 231*a* and disposed in the first flow path body 231, and a first airflow formation part 234 arranged in the first flow path body 231.

The second cyclone formation part 24 may include a second flow path body 241 arranged in a height direction of the lower space 1*b* and having a pipe shape with a closed top surface and an open bottom surface, a second body inlet 241*a* for introducing the air inside the first flow path body 231 into the second flow path body 241, and a second connection duct 243 having one end fixed to the second communication hole 192 and a free end disposed inside the second flow path body 241 through the top surface of the second flow path body 241. The details of the structures of the first cyclone formation part 23 and the second cyclone formation part 24 are the same as those in the above-described embodiment, and thus a detailed description of the structures and functions of the cyclone formation parts will be omitted.

Figure 5:
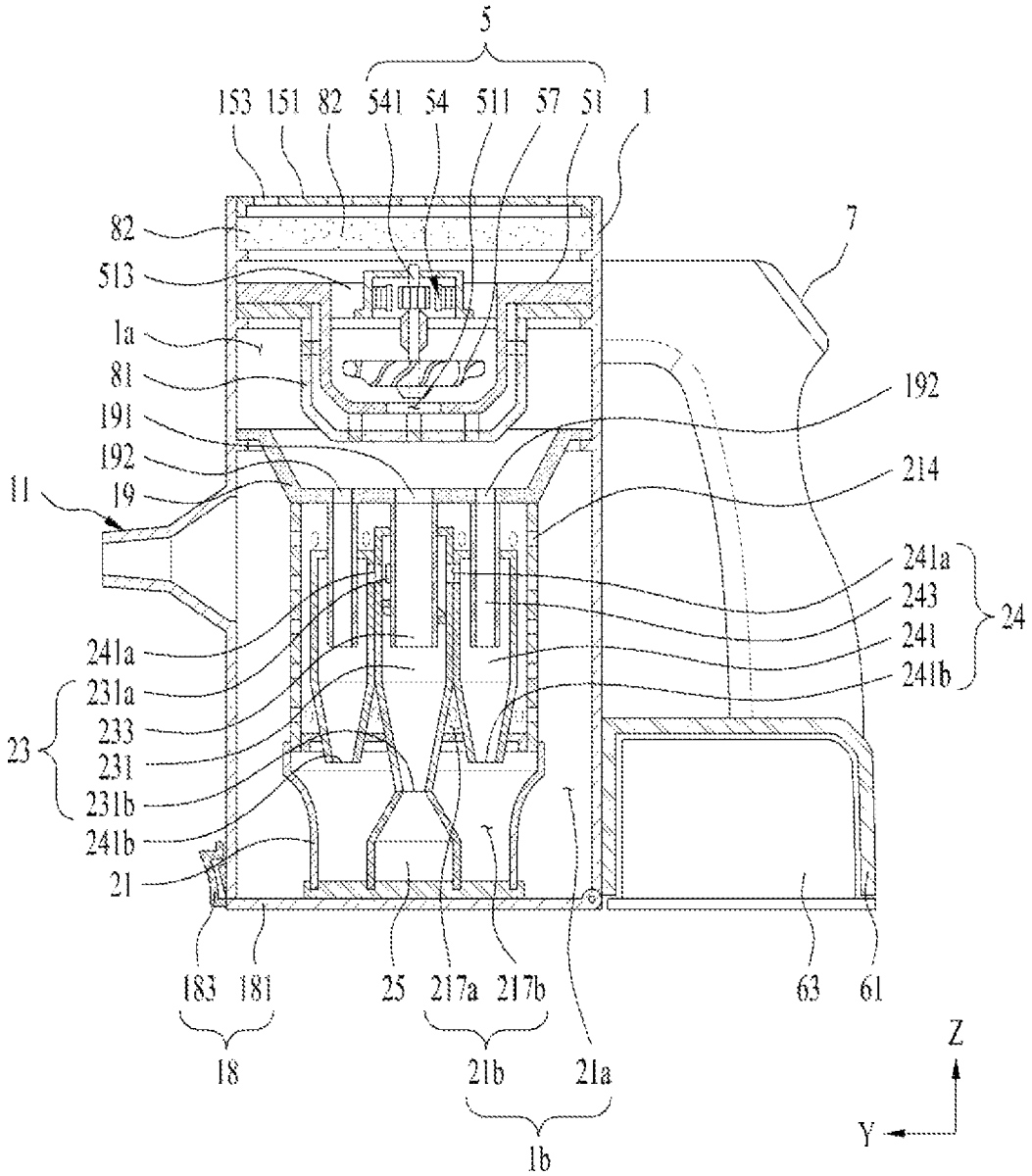
FIGS. 5 to 7 show a dirt separator according to another embodiment of the present disclosure.
Figure 6:
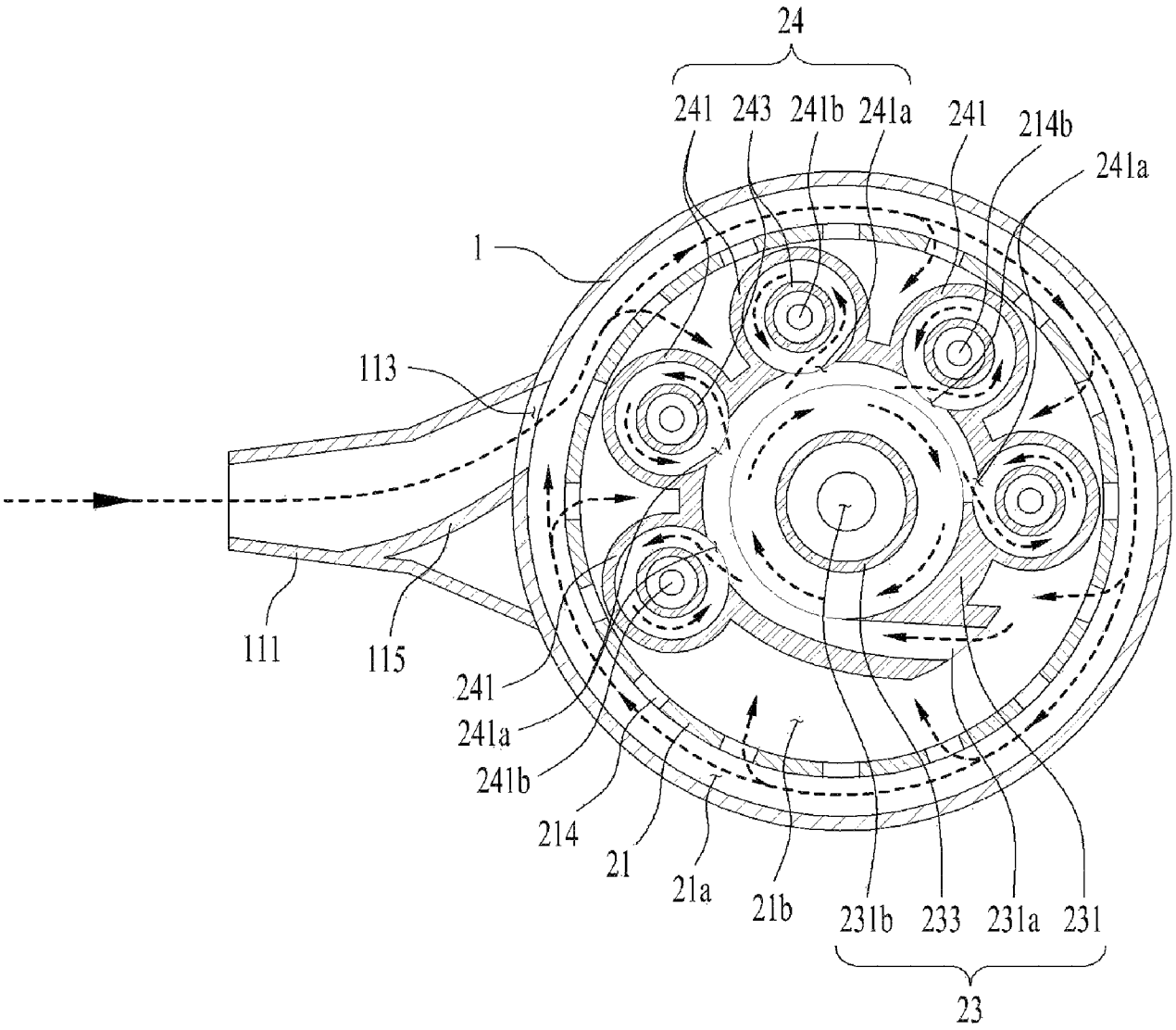
Figure 7:
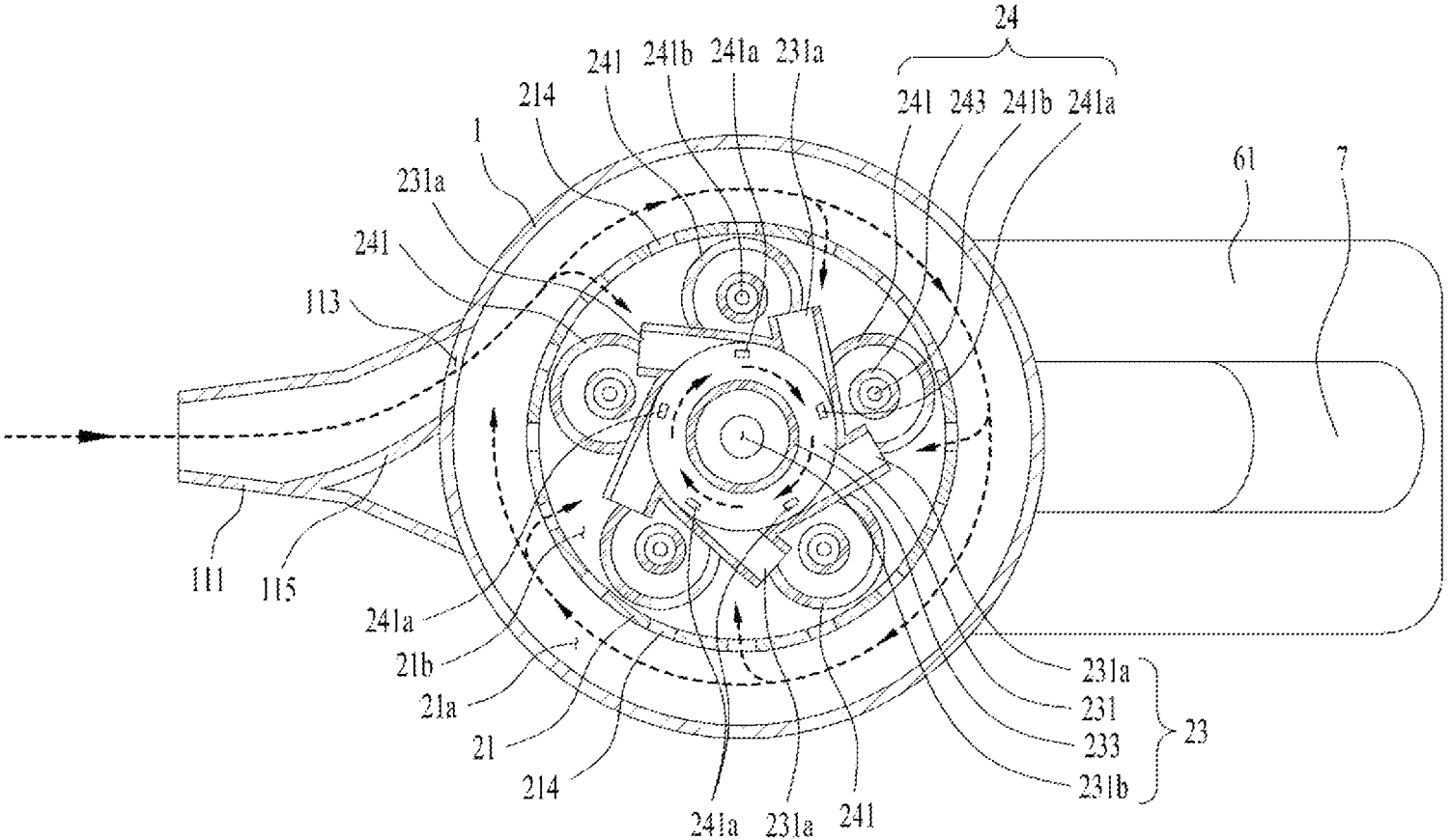

FIGS. 5 to 7 illustrate another embodiment of the cleaner 100. The cleaner according to this embodiment is distinguished from the embodiment of FIG. 2 in that the first body inlet 231*a* for introducing air into the first cyclone formation part 23 is formed in the circumferential surface of the first flow path body 231.

As shown in FIG. 5, the first cyclone formation part 23 according to this embodiment may include a first flow path body 231 having a pipe shape and a first connection duct 233 having a pipe shape. The closed top surface of the first flow path body 231 may be provided in the first space 217*a* and the open bottom surface (first body outlet) may be provided in the second space 217*b* through the chamber partition 217. One end of the first connection duct 233 may be fixed to the first communication hole 191 and the free end of the first connection duct 233 may be provided in the first flow path body 231 through the top surface of the first flow path body 231.

As shown in FIG. 6, a first body inlet 231*a* for supplying air to the first flow path body 231 may be formed in the circumferential surface of the first flow path body 231. The first body inlet 231*a* may cause air to be introduced into the first flow path body in the tangential direction to the circumferential surface of the first flow path body 231. Therefore, the first cyclone formation part 23 according to this embodiment may not require the first airflow formation part 234 provided in the embodiment of FIG. 2.

FIG. 6 illustrates a case where only one first body inlet 231*a* is provided, and FIG. 7 illustrates a case where a plurality of first body inlets 231*a* is provided along the circumferential surface of the first flow path body 231. When a plurality of first body inlets 231*a* is provided, the first body inlets 231*a* may be spaced apart from each other along the circumferential surface of the first flow path body 231 by the same angle. This may quickly generate a cyclonic flow inside the first flow path body 231 and stably maintain the cyclonic flow.

Figure 8:
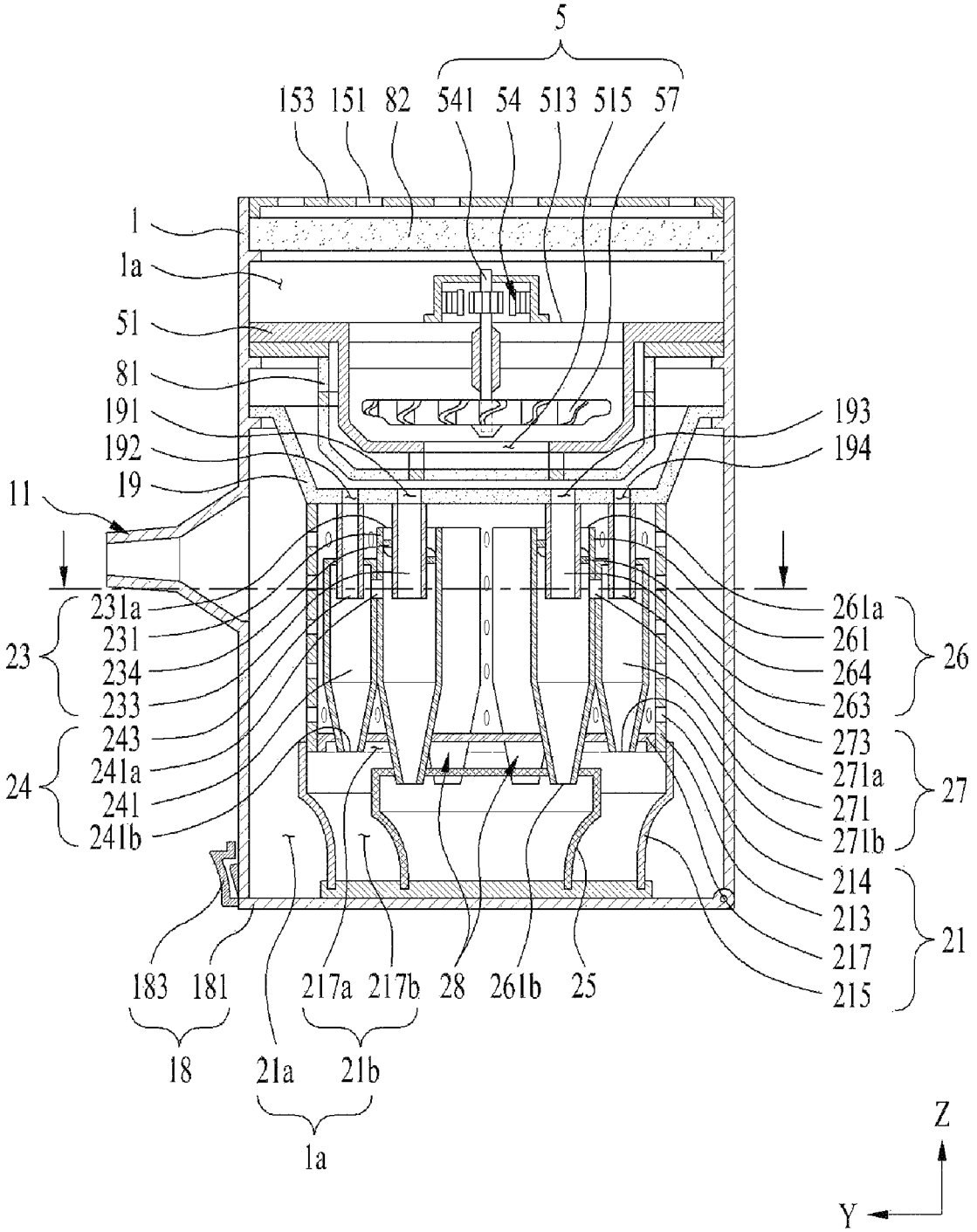
FIGS. 8 and 9 show a dirt separator according to yet another embodiment of the present disclosure.
Figure 9:
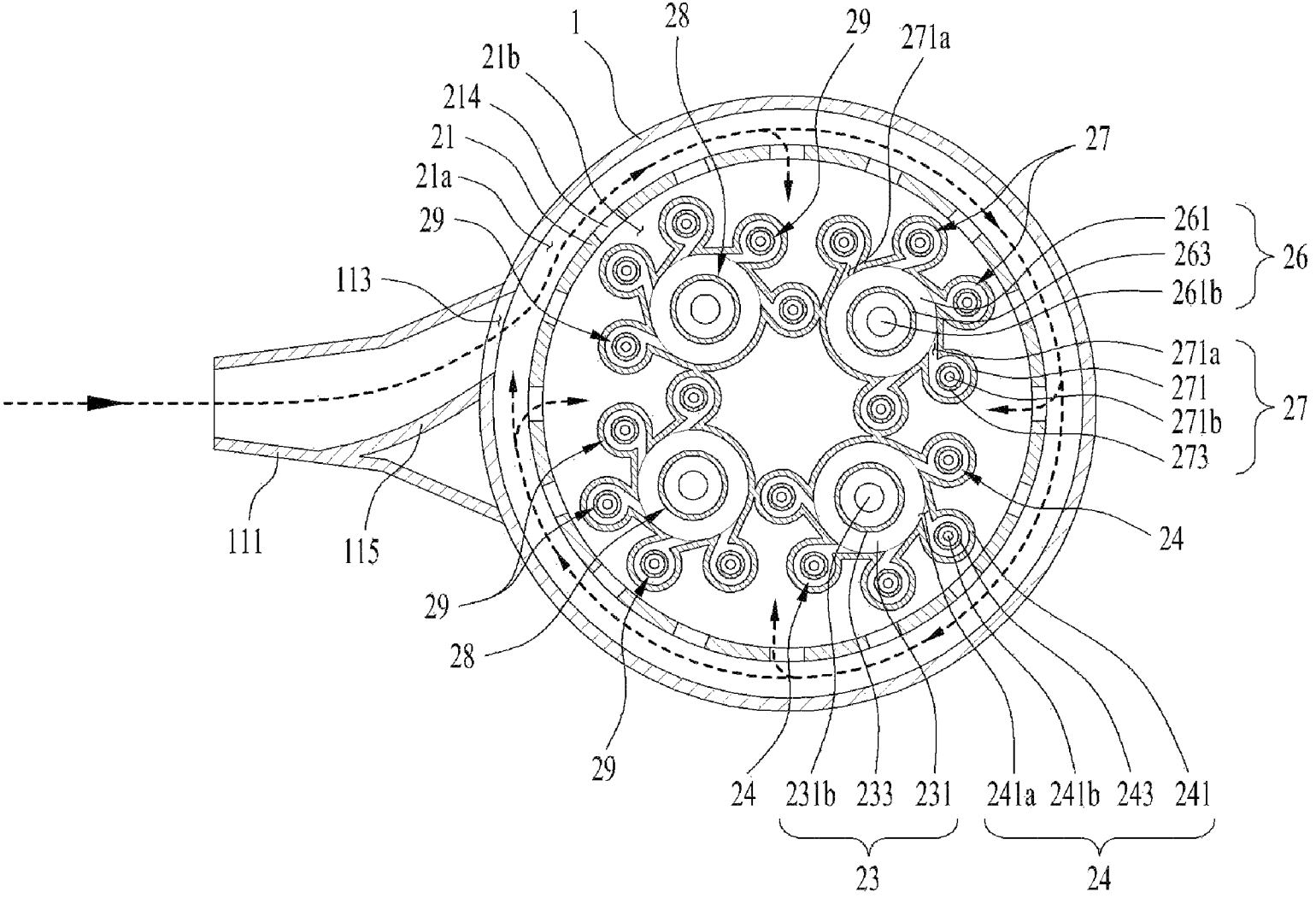

FIGS. 8 and 9 show a cleaner according to yet another embodiment of the present disclosure. The dirt separator provided in this embodiment may include a plurality of first cyclone formation parts 23 and second cyclone formation parts 24.

FIGS. 8 and 9 illustrate a case where the dirt separator includes a plurality of first cyclone formation parts and a plurality of second cyclone formation parts which depend on the first cyclone formation parts, respectively. The dirt separator of FIGS. 8 and 9 may further include a third cyclone formation part 26, a fourth cyclone formation part 27, a fifth cyclone formation part 28, and a sixth cyclone formation part 29.

The third cyclone formation part 26 may be independent from the first cyclone formation part and the fourth cyclone formation part 27 may be dependent on the third cyclone formation part. Likewise, the fifth cyclone formation part 28 may be independent from the first cyclone formation part and the third cyclone formation part, and the sixth cyclone formation part 29 may be dependent on the fifth cyclone formation part.

In this embodiment, the housing partition 19 may further include a third communication hole 193, a fourth communication hole 194, a fifth communication hole, and a sixth communication hole. The third communication hole 193, the fourth communication hole 194, the fifth communication hole, and the sixth communication hole may be arranged such that the first space 217*a* of the second chamber communicates with the upper space 1*a*.

The third cyclone formation part 26 may be provided inside the second chamber 21*b* to provide a flow path for guiding air to the third communication hole 193 and to separate dirt from the air through centrifugal force. The third cyclone formation part 26 may have the same structure as the first cyclone formation part.

The third cyclone formation part 26 may include a third flow path body 261 having a pipe shape and extending from the cover 18 forming the bottom surface of the lower space toward the housing partition 19, a third body inlet 261*a* formed in the top surface of the third flow path body 261 for introducing air into the third flow path body 261, a third connection duct 263 having one end fixed to the third communication hole 193 and a free end inserted into the third body inlet 261*a* and disposed in the third flow path body 261, a third connecting pipe 263 inserted into the third flow path body 261*a*, and a third airflow formation part 264 disposed between the third body inlet 261*a* and the free end of the third connection duct 263 to rotate the air introduced through the third body inlet 261*a* inside the third flow path body 261.

When the lower space is divided into a first chamber 21*a* and a second chamber 21*b* and the second chamber 21*b* is divided into a first space 217*a* and a second space 217*b* by the chamber partition 217, the third flow path body 261 may be provided as a pipe having one end disposed in the first space 217*a* and an opposite end disposed in the second space 217*b*. In this case, the third body fluid inlet 261*a* may be provided at the upper end of the third flow path body 261, and the third body outlet 261*b* for discharging dirt to the second space 217*b* may be provided at the lower end of the third flow path body 261.

The fourth cyclone formation part 27 may be provided inside the second chamber 21*b* and may provide a flow path for guiding a portion of the air introduced into the third cyclone formation part 26 to the fourth communication hole 194 and to separate dirt from the air through the centrifugal force. The fourth cyclone formation part 27 may have the same structure as the second cyclone formation part 24.

The fourth cyclone formation part 27 may include a fourth flow path body 271 arranged in a height or vertical direction of the lower space and having a pipe shape with a closed top surface and an open bottom surface, a fourth body inlet 271*a* for introducing the air from the third flow path body 261 into the fourth flow path body 271, and a fourth connection duct 273 having one end fixed to the fourth communication hole 194 and a free end disposed inside the fourth flow path body 271 through the top surface of the fourth flow path body 271.

As shown in FIG. 9, the fourth body inlet 271*a* may connect the circumferential surface of the third flow path body 261 and the circumferential surface of the fourth flow path body 271. A fourth airflow formation part configured to rotate the air supplied through the fourth body inlet 271*a* may be further provided in the fourth flow path body 271. When the fourth body inlet 271*a* is arranged to introduce the air inside the third flow path body 261 into the fourth flow path body 271 in the tangential direction to the circumferential surface of the fourth flow path body 271, the fourth body inlet 271*a* may perform a function similar to the fourth airflow formation part.

As shown in FIG. 8, when the lower space is divided into a first chamber 21*a* and a second chamber 21*b* and the second chamber 21*b* is divided into a first space 217*a* and a second space 217*b* by the chamber partition 217, the fourth flow path body 271 may be provided as a pipe having one end disposed in the first space 217*a* and an opposite end disposed in the second space 217*b*. In this case, a fourth body outlet 271*b* for discharging dirt to the second space 217*b* may be provided at the lower end of the fourth flow path body 271.

The fifth cyclone formation part 28 may be provided inside the second chamber 21*b* to provide a flow path for guiding air to the fifth communication hole, and the sixth cyclone formation part 29 may be provided inside the second chamber 21*b* to provide a flow path for guiding a portion of the air introduced into the fifth cyclone formation part 28 to the sixth communication hole.

The fifth cyclone formation part 28 may have the same structure as the first cyclone formation part described above, and the sixth cyclone formation part 29 may have the same structure as the second cyclone formation part described above. Thus, a detailed description of the fifth and sixth cyclone formation parts will be omitted.

In this embodiment, a storage body 25 configured to store dirt discharged from the first cyclone formation part 23, dirt discharged from the third cyclone formation part 27, and dirt discharged from the fifth cyclone formation part 28 may be further provided in the second space 217*b*. The storage body 25 may divide the second space 217*b* into a space communicating with the first cyclone formation part 23, the third cyclone formation part 26 and the fifth cyclone formation part 28, and a space communicating with the second cyclone formation part 24, the fourth cyclone formation part 27, and the sixth cyclone formation part 29.

According to the present disclosure, a cleaner may minimize a decrease in pressure of air when air is introduced into a dirt separator configured to separate dirt from the air. It will be apparent to those skilled in the art that various modifications and variations can be made in the present invention without departing from the spirit and scope of the invention. Thus, it is intended that the present invention cover the modifications and variations of this invention provided they come within the scope of the appended claims and their equivalents.

Accordingly, the present embodiments are directed to a cleaner that substantially obviates one or more problems due to limitations and disadvantages of the related art. An object of the embodiments is to provide a cleaner capable of minimizing a decrease in pressure of air when air is introduced into a dirt separator configured to separate dirt from the air.

A cleaner may include a housing having a hollow inner space, a housing partition configured to divide the inner space of the housing into an upper space and a lower space, a first communication hole and a second communication hole formed to penetrate the housing partition to allow the upper space and the lower space to communicate with each other, a suction part allowing the lower space to communicate with an outside of the housing, an air discharge part allowing the upper space to communicate with the outside of the housing, a fan arranged in the upper space to move air from the lower space to the air discharge part, a first cyclone formation part arranged in the lower space to provide a flow path for guiding air introduced into the suction part to the first communication hole and to separate dirt from the air through centrifugal force, and a second cyclone formation part arranged in the lower space to provide a flow path for guiding a portion of air introduced into the first cyclone formation part to the second communication hole and to separate dirt from the air through centrifugal force.

The first cyclone formation part may include a first flow path body having a pipe shape and extending from a bottom surface of the lower space toward the housing partition, a first body inlet provided in a top surface of the first flow path body to introduce air into the first flow path body, a first connection duct having one end fixed to the first communication hole and a free end inserted into the first body inlet and disposed inside the first flow path body, and a first airflow formation part disposed between the first body inlet and the free end of the first connection duct to rotate air introduced through the first body inlet inside the first flow path body, wherein the second cyclone formation part may include a second flow path body arranged in a height direction of the lower space and having a closed top surface and an open bottom surface, a second body inlet configured to introduce air inside the first flow path body into the second flow path body, and a second connection duct having one end fixed to the second communication hole and a free end disposed inside the second flow path body through the top surface of the second flow path body.

The second body inlet may penetrate the circumferential surface of the first flow path body and the circumferential surface of the second flow path body. The second body inlet may be configured to introduce air into the second flow path body in a tangential direction to the circumferential surface of the second flow path body.

The second cyclone formation part may include two or more cyclone formation parts, wherein the cyclone formation parts of the second cyclone formation part may be equally spaced apart along the circumferential surface of the first flow path body. The cleaner may further include a storage body arranged on the bottom surface of the lower space to provide a space for storing dirt, and a first body outlet provided in a bottom surface of the first flow path body to discharge dirt from the first flow path body to the storage body.

The cleaner may further include a chamber body formed in a shape of a hollow cylinder and extending from the housing partition to the bottom surface of the lower space, the chamber body dividing the lower space into a first chamber communicating with the suction part and a second chamber communicating with the first communication hole and the second communication hole, a chamber partition configured to divide the second chamber into a first space communicating with the first communication hole and the second communication hole and a second space not communicating with any of the first communication hole and the second communication hole, and a chamber communication hole formed to penetrate the chamber body to allow the first space to communicate with the first chamber, wherein the first cyclone formation part and the second cyclone formation part are arranged in the second chamber.

The first cyclone formation part may include a first flow path body formed in a pipe shape and provided with a first body inlet for introducing air and a first body outlet for discharging dirt, the first body inlet being disposed in the first space and the first body outlet being disposed in the second space through the chamber partition, a first connection duct having one end fixed to the first communication hole and a free end inserted into the first body inlet and disposed inside the first flow path body, and a first airflow formation part disposed between the first body inlet and the free end of the first connection duct to rotate air introduced through the first body inlet inside the first flow path body, wherein the second cyclone formation part may include a second flow path body formed in a pipe shape and having a closed top surface disposed in the first space and an open bottom surface disposed in the second space through the chamber partition, a second body inlet configured to introduce air inside the first flow path body into the second flow path body, and a second connection duct having one end fixed to the second communication hole and a free end disposed inside the second flow path body through the top surface of the second flow path body.

The cleaner may further include a storage body arranged in the second space to store dirt discharged through the first body outlet. The first cyclone formation part may include a first flow path body formed in a pipe shape and having a closed top surface disposed in the first space and an open bottom surface disposed in the second space through the chamber partition, a first body inlet formed in a circumferential surface of the first flow path body to introduce air into the first flow path body, and a first connection duct having one end fixed to the first communication hole and a free end disposed inside the first flow path body through the top surface of the first flow path body, wherein the second cyclone formation part may include a second flow path body formed in a pipe shape and having a closed top surface disposed in the first space and an open bottom surface disposed in the second space through the chamber partition, a second body inlet configured to introduce air inside the first flow path body into the second flow path body, and a second connection duct having one end fixed to the second communication hole and a free end disposed inside the second flow path body through the top surface of the second flow path body, wherein the first body inlet may be configured to introduce air into the first flow path body in a tangential direction to the circumferential surface of the first flow path body.

The second body inlet may connect the circumferential surface of the first flow path body and a circumferential surface of the second flow path body to each other to cause air inside the first flow path body to flow into the second flow path body in a tangential direction to the circumferential surface of the second flow path body.

The cleaner may further include a storage body arranged in the second space to store dirt discharged through the open bottom surface of the first flow path body. The storage body may divide the second space into a space for storing dirt discharged from the second flow path body and a space for storing dirt discharged from the first flow path body.

The cleaner may further include a third communication hole and a fourth communication hole formed to penetrate the housing partition to allow the upper space and the lower space to communicate with each other, a third cyclone formation part arranged in the lower space to provide a flow path for guiding air introduced into the suction part to the third communication hole and to separate dirt from the air through centrifugal force, and a fourth cyclone formation part arranged in the lower space to provide a flow path for guiding a portion of air introduced into the third cyclone formation part to the fourth communication hole and to separate dirt from the air through centrifugal force.

The third cyclone formation part may include a third flow path body having a pipe shape and extending from a bottom surface of the lower space toward the housing partition, a third body inlet provided in a top surface of the third flow path body to introduce air into the third flow path body, a third connection duct having one end fixed to the third communication hole and a free end inserted into the third body inlet and disposed inside the third flow path body, and a third airflow formation part disposed between the third body inlet and the free end of the third connection duct to rotate air introduced through the third body inlet inside the third flow path body, wherein the fourth cyclone formation part may include a fourth flow path body arranged in a height direction of the lower space and having a closed top surface and an open bottom surface, a fourth body inlet configured to introduce air inside the third flow path body into the fourth flow path body, and a fourth connection duct having one end fixed to the fourth communication hole and a free end disposed inside the fourth flow path body through the top surface of the fourth flow path body.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a housing having a hollow inner space;

a housing partition configured to divide the inner space of the housing into a first space and a second space;

a first communication hole and a plurality of second communication holes formed in the housing partition to allow the first space and the second space to communicate with each other, the second communication holes being provided around the first communication hole;

an inlet through which air from an outside of the housing is introduced into the second space;

an air discharge port through which air in the first space is exhausted to the outside of the housing;

a fan arranged in the first space and configured to draw air from the second space toward the air discharge port;

a first cyclone configured to be connected to the first communication hole and arranged in the second space and configured to provide a flow path through which the air introduced through the inlet flows to the first communication hole; and a second cyclone configured to be connected to the second communication holes, arranged in the second space, and configured to provide a flow path through which a portion of the air introduced into the first cyclone flows to the second communication holes.

2. The cleaner of claim 1, wherein the first cyclone comprises:

a first flow path body having a pipe shape and extending from a bottom of the second space toward the housing partition;

a first body inlet provided at a first end of the first flow path body to introduce air into the first flow path body;

a first connection duct having a first end fixed to the first communication hole and a second end inserted into the first body inlet and arranged inside the first flow path body; and a first guide vane provided between the first flow path body and the first connection duct to induce rotation of the air introduced through the first body inlet to the inside the first flow path body, and wherein the second cyclone comprises:

a second flow path body arranged in the second space adjacent to the first flow path body and having a closed first end and an open second end;

a second body inlet configured to introduce air from inside the first flow path body into the second flow path body; and a second connection duct having a first end fixed to at least one of the second communication holes and a second end arranged inside the second flow path body through the closed first end of the second flow path body.

3. The cleaner of claim 2, wherein the second body inlet is formed in a circumferential surface of the first flow path body and a circumferential surface of the second flow path body.

4. The cleaner of claim 3, wherein the second body inlet is configured to introduce air into the second flow path body in a direction tangential to the circumferential surface of the second connection duct.

5. The cleaner of claim 3, wherein the second cyclone comprises two or more second cyclones, and wherein the second cyclones are equally spaced apart around the circumferential surface of the first flow path body.

6. The cleaner of claim 3, further comprising:

a storage body arranged under the second space; and a first body outlet provided at a second end of the first flow path body to discharge dirt from the first flow path body to the storage body.

7. The cleaner of claim 1, further comprising:

a chamber body formed in a shape of a hollow cylinder and extending from the housing partition to the bottom of the second space, the chamber body dividing the second space into a first chamber that communicates with the inlet and a second chamber that communicates with the first communication hole and the second communication holes;

a chamber partition configured to divide the second chamber into a suction space communicating with the first communication hole and the second communication holes and a storage space not communicating with any of the first communication hole or the second communication holes; and a chamber communication hole formed in the chamber body to allow the suction space to communicate with the first chamber, wherein the first cyclone and the second cyclone are arranged in the second chamber, and wherein the chamber body is configured to separate first foreign objects having a first size from the air, and the first and second cyclones are configured to separate second foreign objects having a second size smaller than the first size from the air.

8. The cleaner of claim 7, wherein the first cyclone comprises:

a first flow path body having a pipe shape and including a first body inlet through which air is introduced into the first flow path body and a first body outlet through which the second foreign objects are expelled from the first flow path body, the first body inlet being provided in the suction space and the first body outlet being provided in the storage space through the chamber partition;

a first connection duct having a first end fixed to the first communication hole and a second end inserted into the first body inlet and provided inside the first flow path body; and a first guide vane provided between the first flow path body and the first connection duct to induce a rotation of air introduced through the first body inlet inside the first flow path body, and wherein the second cyclone comprises:

a second flow path body having a pipe shape and having a closed first end provided in the suction space and an open second end provided in the storage space through the chamber partition;

a second body inlet configured to introduce air from inside the first flow path body into the second flow path body; and a second connection duct having a first end fixed to at least one of the second communication holes and a second end provided inside the second flow path body through the closed first end of the second flow path body.

9. The cleaner of claim 8, further comprising:

a storage body arranged in the storage space to store the second foreign objects discharged through the first body outlet.

10. The cleaner of claim 7, wherein the first cyclone comprises:

a first flow path body having a pipe shape and having a closed first end provided in the suction space and an open second end provided in the storage space through the chamber partition;

a first body inlet formed in a circumferential surface of the first flow path body to introduce air into the first flow path body; and a first connection duct having a first end fixed to the first communication hole and a second end provided inside the first flow path body through the closed first end of the first flow path body, and wherein the second cyclone comprises:

a second flow path body having a pipe shape and having a closed first end provided in the suction space and an open second end provided in the storage space through the chamber partition;

a second body inlet configured to introduce air from inside the first flow path body into the second flow path body; and a second connection duct having a first end fixed to at least one of the second communication holes and a second end provided inside the second flow path body through the closed first end of the second flow path body, wherein the first body inlet is configured to introduce air into the first flow path body in a direction tangential to a circumferential surface of the first connection duct.

11. The cleaner of claim 10, wherein the second body inlet connects the circumferential surface of the first flow path body and a circumferential surface of the second flow path body to each other to cause air inside the first flow path body to flow into the second flow path body in a tangential direction to the circumferential surface of the second connection duct.

12. The cleaner of claim 11, further comprising:

a storage body arranged in the storage space to store the second foreign objects discharged through the open bottom surface of the first flow path body.

13. The cleaner of claim 2, further comprising:

a third communication hole and a fourth communication hole in the housing partition to allow the first space and the second space to communicate with each other;

a third cyclone arranged in the second space to provide a flow path for air introduced into the inlet to the third communication hole and to separate foreign objects from the air; and a fourth cyclone arranged in the second space to provide a flow path for a portion of the air introduced into the third cyclone to the fourth communication hole and to separate foreign objects from the air.

14. The cleaner of claim 13, wherein the third cyclone comprises:

a third flow path body having a pipe shape and extending from a bottom of the second space toward the housing partition;

a third body inlet provided at a first end of the third flow path body to introduce air into the third flow path body;

a third connection duct having a first end fixed to the third communication hole and a second end inserted into the third body inlet and provided inside the third flow path body; and a third guide vane provided between the third flow path body and the third connection duct to induce rotation in the air introduced through the third body inlet inside the third flow path body, and wherein the fourth cyclone comprises:

a fourth flow path body arranged in the second space adjacent to the third flow path body and having a closed first end and an open second end;

a fourth body inlet configured to introduce air from inside the third flow path body into the fourth flow path body; and a fourth connection duct having a first end fixed to the fourth communication hole and a second end provided inside the fourth flow path body through the first end of the fourth flow path body.

15. A cleaner, comprising:

a housing including an air inlet and an air discharge port;

a partition that partitions an interior of the housing into a first space and a second space, the first space being located above the second space;

a first communication hole and a plurality of second communication holes formed in the partition to allow the first space and the second space to communicate with each other, the second communication holes being provided around the first communication hole;

a first cyclone configured to be connected to the first communication hole, provided in the second space, and configured to separate first foreign objects from air provided through the air inlet;

a plurality of second cyclones configured to be connected to the second communication holes, provided within the at least one first cyclone, and configured to separate second foreign objects from the air that has passed through the first cyclone, at least one of the plurality of second cyclones including an inlet hole through a circumferential wall thereof and in communication with an inside of an adjacent second cyclone;

a connection duct provided in each of the plurality of second cyclones and configured to guide air from the inside of each of the plurality of second cyclones to the first space; and a guide vane provided between an inner circumferential surface of each of the plurality of second cyclones and an outer circumferential surface of the connection duct and configured to produce cyclonic airflow inside each of the plurality of second cyclones.

16. The cleaner of claim 15, wherein at least one of the plurality of second cyclones has an open top through which the air that has passed through the first cyclone enters the plurality of second cyclones.

17. The cleaner of claim 16, wherein the plurality of second cyclones comprises a main second cyclone provided at a center of the second space and a plurality of auxiliary second cyclones arranged equidistant from each other around an outer circumferential surface of the main second cyclone.

18. The cleaner of claim 17, wherein the connection ducts of the plurality of auxiliary second cyclones protrude through a top surface of each the plurality of auxiliary second cyclones.

19. The cleaner of claim 15, further comprising a fan arranged in the first space and configured to draw air from the inlet through the first cyclone and the plurality of second cyclones into the first space and exhaust the air through the air discharge port.

20. The cleaner of claim 15, further comprising a storage space provided below the first space and configured to store the second foreign objects separated from the air in the plurality of second cyclones.

* * * * *